US007950626B2

(12) United States Patent
Martin

(10) Patent No.: US 7,950,626 B2
(45) Date of Patent: May 31, 2011

(54) COLLAPSIBLE ENGINE HOIST

(76) Inventor: Herb Martin, Avon, NY (US)

( * ) Notice: Subject to any disclaimer, the term of this patent is extended or adjusted under 35 U.S.C. 154(b) by 0 days.

(21) Appl. No.: 11/879,869

(22) Filed: Jul. 19, 2007

(65) Prior Publication Data

US 2008/0157041 A1 Jul. 3, 2008

Related U.S. Application Data

(60) Provisional application No. 60/832,258, filed on Jul. 20, 2006.

(51) Int. Cl.
*B66F 7/26* (2006.01)

(52) U.S. Cl. ..... 254/2 R; 254/2 B; 269/17

(58) Field of Classification Search ..... 254/2 R, 254/3 B, 2 B, 134; 269/17
See application file for complete search history.

(56) References Cited

U.S. PATENT DOCUMENTS

| | | | | | |
|---|---|---|---|---|---|
| 2,821,406 | A * | 1/1958 | Hoyer et al. | ..... | 280/657 |
| 2,994,939 | A * | 8/1961 | Matthews | ..... | 28/208 |
| 4,123,038 | A * | 10/1978 | Meyers | ..... | 254/2 R |
| 5,358,217 | A * | 10/1994 | Dach | ..... | 254/2 R |
| 5,662,315 | A * | 9/1997 | Neiss et al. | ..... | 269/17 |
| 6,533,260 | B1 * | 3/2003 | Mock | ..... | 269/17 |
| 6,572,092 | B2 * | 6/2003 | DuVernay et al. | ..... | 269/71 |
| 7,296,787 | B2 * | 11/2007 | Barrios et al. | ..... | 269/17 |
| 2008/0157041 | A1 * | 7/2008 | Martin | ..... | 254/2 R |

* cited by examiner

*Primary Examiner* — Lee D Wilson
(74) *Attorney, Agent, or Firm* — Hiscock & Barclay, LLP

(57) ABSTRACT

The present invention relates to a collapsible hoist that can be easily stored and set up. The hoist is designed to provide sufficient lifting support to lift large objects such as an engine out of an engine compartment. Further, the invention provides the ability to transport and operate a hoist in a garage or in the field.

16 Claims, 25 Drawing Sheets

COLLAPSIBLE ENGINE HOIST

This application claims the benefit of U.S. Provisional Patent Application Ser. No. 60/832,258, filed Jul. 20, 2006, which is hereby incorporated by reference in its entirety.

FIELD OF THE INVENTION

The present invention relates to a portable hoist which is designed to be collapsible and easily stored and set up.

BACKGROUND OF THE INVENTION

Numerous devices have been developed for lifting of heavy loads. In particular, many various forms of engine hoists have been described or are commercially available. Known prior art engine hoists include U.S. Pat. Nos. 5,261,640; 5,052,566; 4,770,304; U.S. Pat. No. Des. 349,996; U.S. Pat. Nos. 4,497,469; 4,090,625, 5,897,101, and 5,261,640.

Many of the prior art devices are optimized for use in a garage environment and are not suitable for use in the field.

The current invention provides a lifting device capable of lifting large loads and being able to move the load once lifted. The device is collapsible so that it takes up minimal space and can be easily transported. Furthermore, the device is lightweight so that one or two men can set up and operate the hoist in the field. Furthermore, the device is designed to provide a high degree of stability and safety even when used to lift heavy objects such as large engines.

The current invention provides the ability to set up, taken down, and move quickly a stable hoist. This would be a plus especially in the trucking industry and a tremendous advantage to the military. In each case, a lifting device that can be quickly set up and used without the need of a power source such as hydraulics, electric motors, etc. just manpower, and if need be, by a single individual has great benefit.

In view of the foregoing background, it is therefore an object of the present invention to provide a portable engine hoist for automotive mechanics to lift and retrieve heavy engines from vehicles in remote locations, where traditional engine-hoisting devices cannot be operated.

SUMMARY OF THE INVENTION

The current invention provides a collapsible hoist that can easily be set up in the field. The hoist is preferably used to lift engines and in particular engines from large trucks.

DETAILED DESCRIPTION OF THE INVENTION

The current invention provides a device capable of lifting an engine out of an engine compartment. Further, the invention provides the ability to transport the engine. The device is collapsible requiring minimal storage space and is easily set up in a garage or in the field.

In a preferred embodiment of the invention, the hoist has sufficient with and height to provide sufficient clearance from trucks with larger clearance requirements.

In a preferred embodiment, the device is designed so that it extends at least eight feet high and has an eight foot width when fully extended. In a more preferred embodiment, the hoist has a height of ten feet and has a ten foot width when extended.

The device is easily assembled. Although bolts can be used to secure the components in position, the components are preferably secured in place with pins or sliding sleeves to minimize the amount of work necessary to assemble the device.

The weight of the device is minimized to increase the ease of assembly and use. Preferably, the device can be assembled by two individuals or more preferred be assembled by a single individual. The preferred weight is less than 500 pounds and more preferred if the total weight is less than 300 pounds. In another preferred embodiment, the device.

Figure 4:
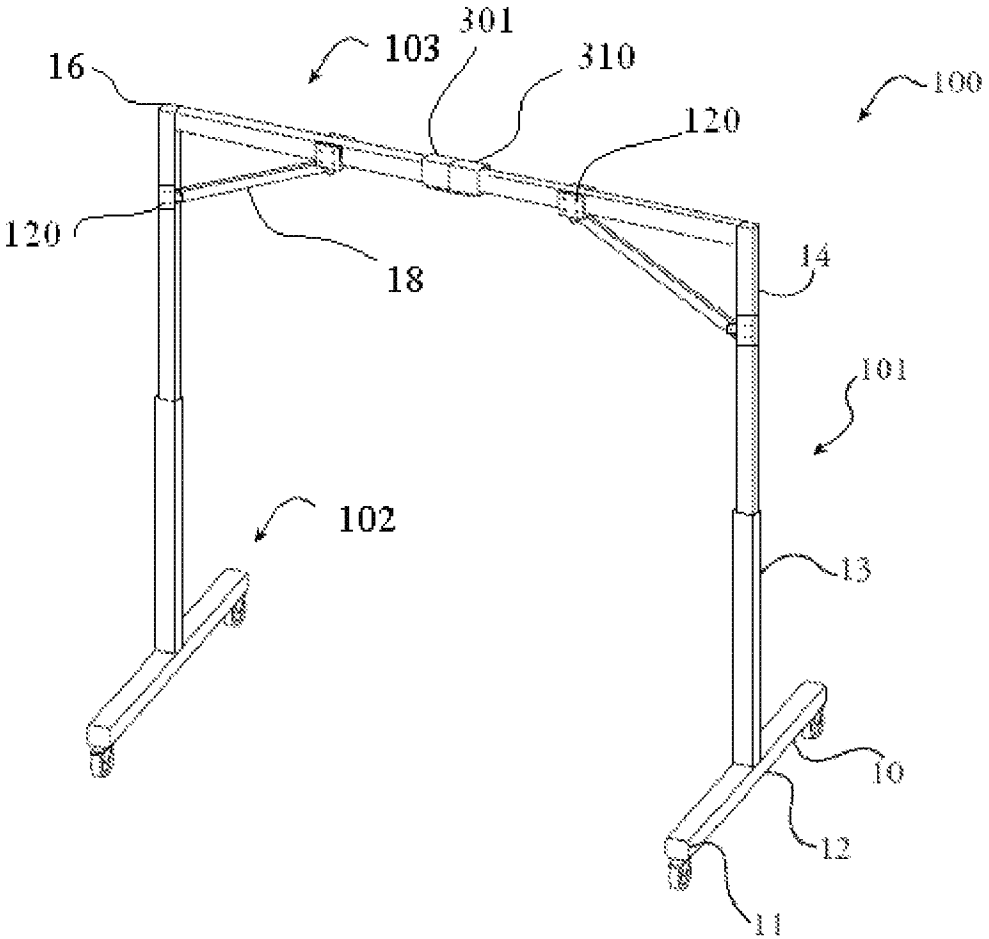
FIG. 4 shows the complete hoist assembly.
Figure 5:
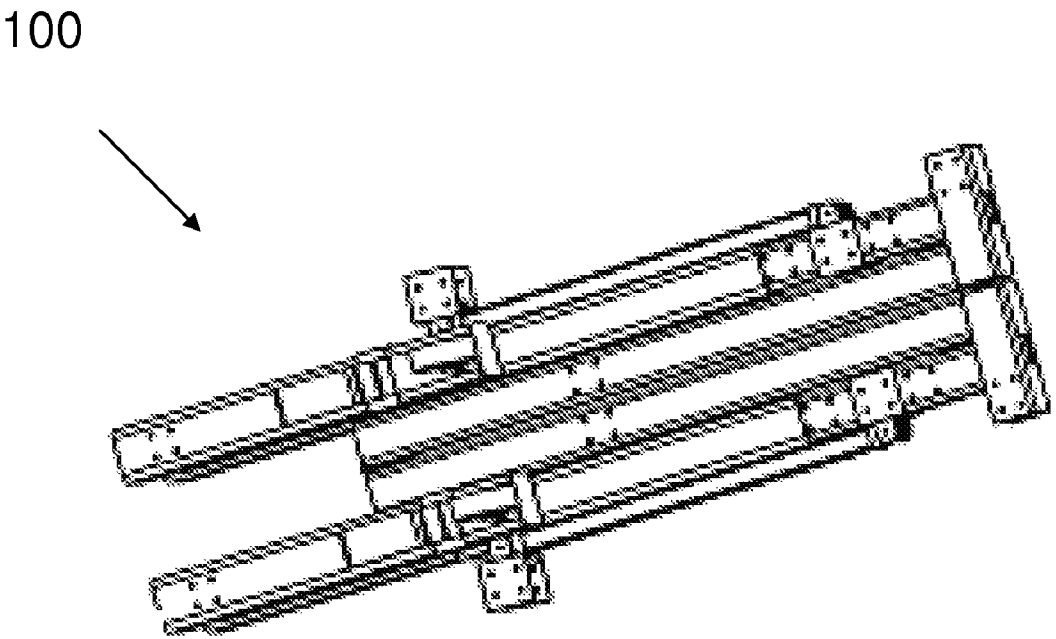
FIG. 5 shows the hoist assembly collapsed.
Figure 6:
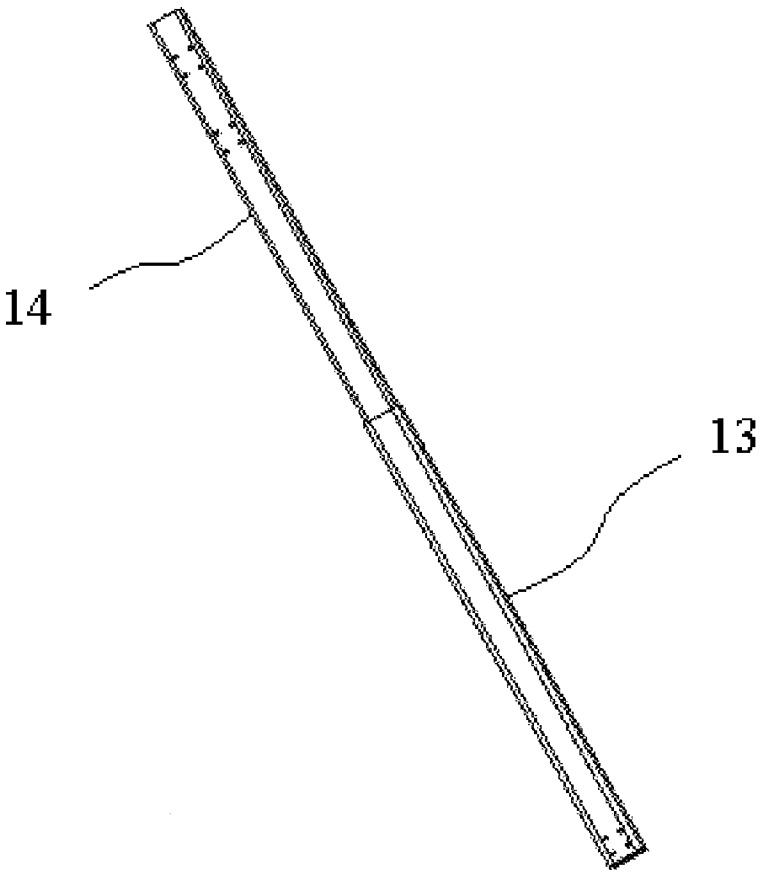
FIG. 6 shows the leg assembly.
Figure 7:
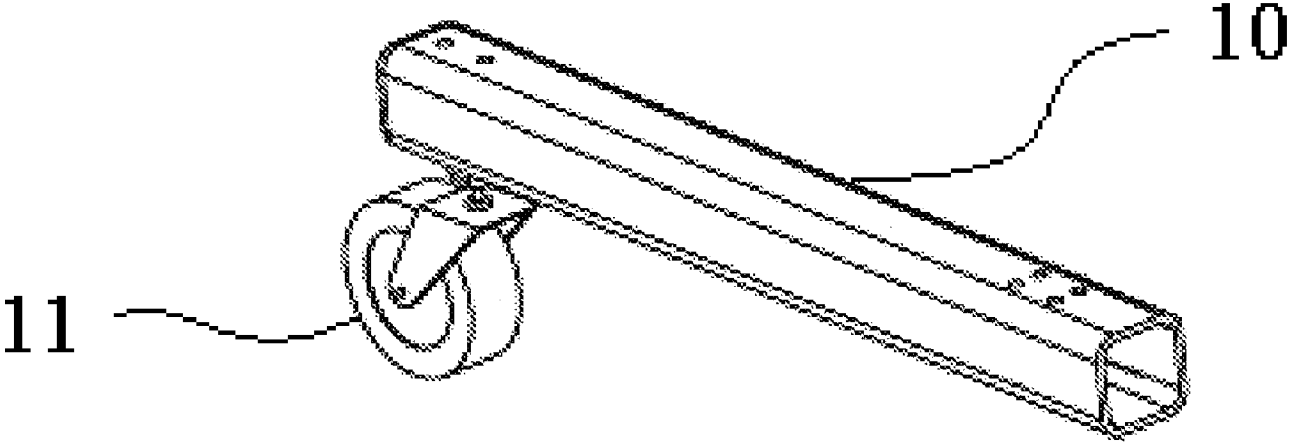
FIG. 7 shows the leg base assembly, including the castor.
Figure 8:
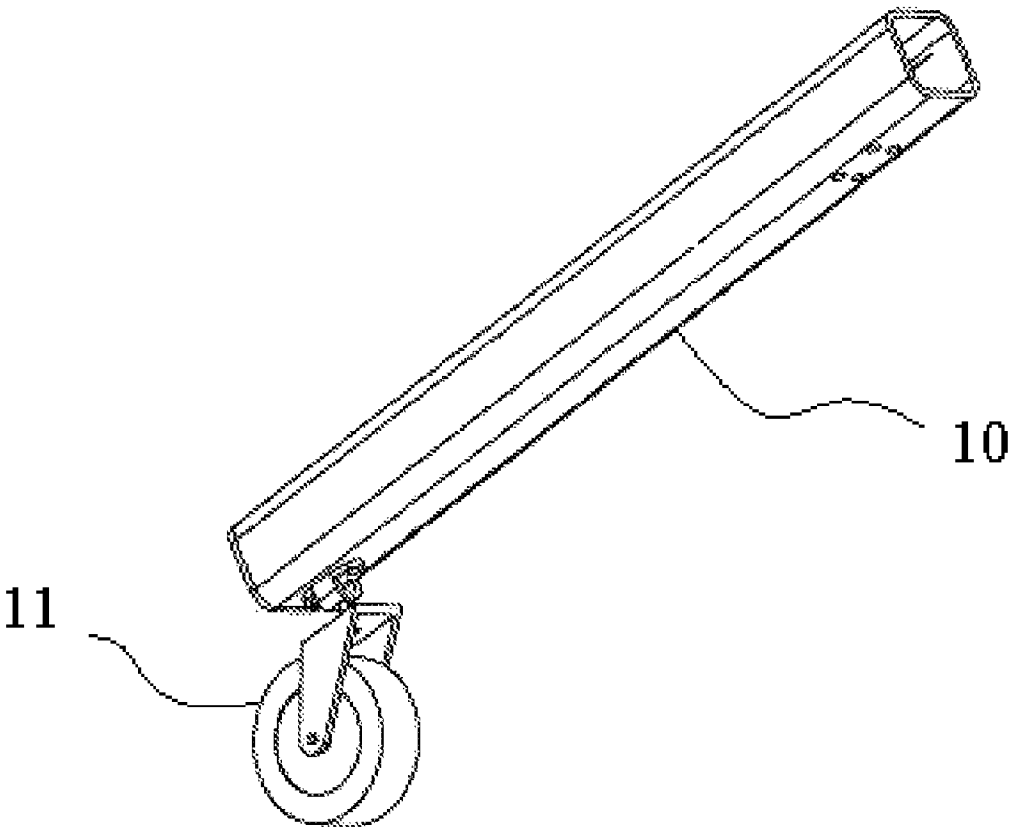
FIG. 8 shows the leg base assembly from below.

A preferred embodiment of the invention is depicted in FIG. 4 and FIG. 5. In FIG. 4, the hoist 100 is set up for use. Two leg assemblies 101 are supported by leg base assemblies 102. Each leg base assembly 102 may be supported by rolling castors 11 to allow for easy movement of the hoist 100. Angle supports 12 are attached to the base 10 of the leg assembly 101 and are used to lock the leg assembly 101 into place using pins or bolts. The leg assembly 101 consists of two components, the first component 14 slides inside the second component 13 to allow the height to be varied and for collapse of the hoist 100 when not in use. A spring 15 may be used to assist in the extension of the leg assembly 101.

Figure 12:
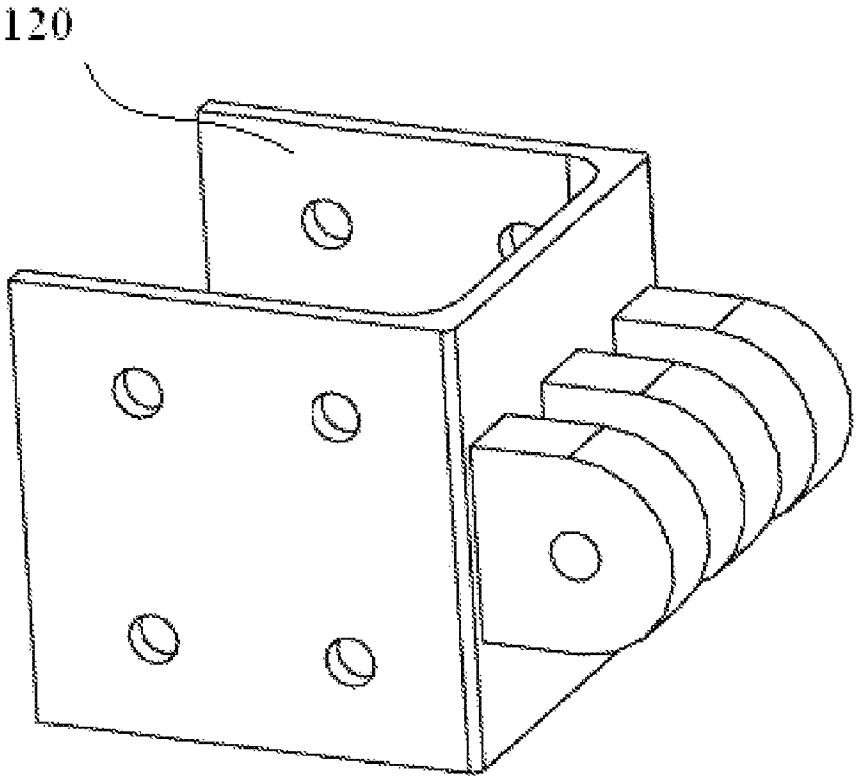
FIG. 12 shows the side lockside.
Figure 13:
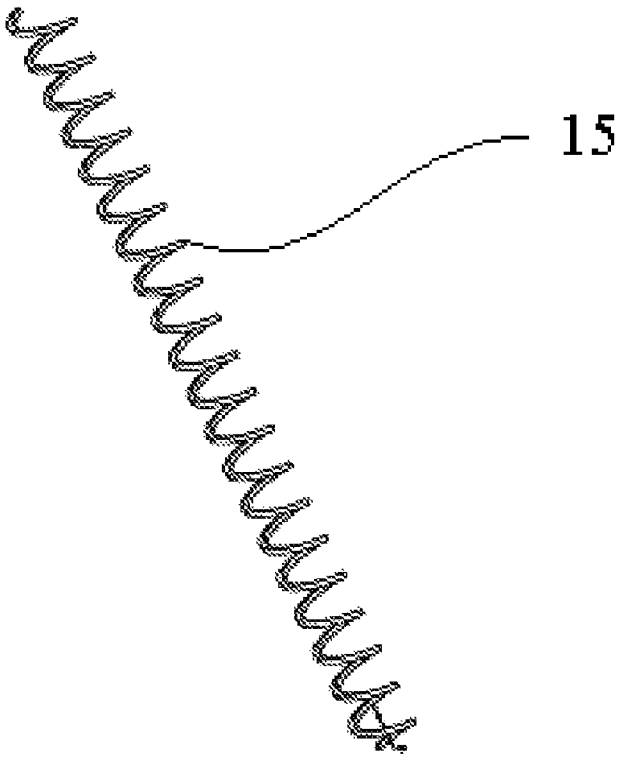
FIG. 13 shows the spring.
Figure 14:
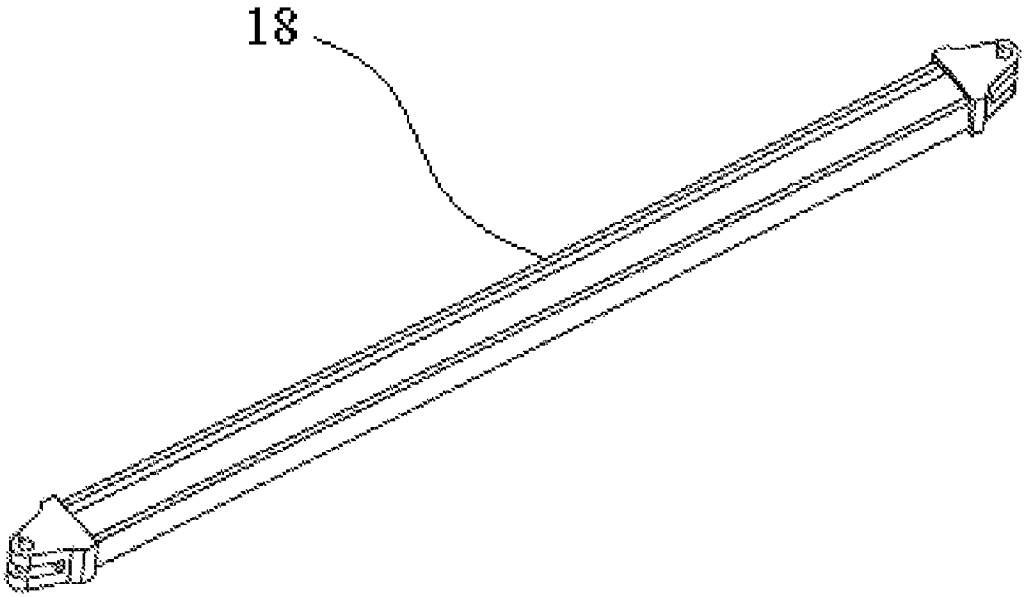
FIG. 14 shows the support arm.

The leg supports are connected to the ends of an upper support 103 by means of a hinge mechanism 16. In a preferred embodiment, the legs are connected to the upper support via a lock side 120 as shown in FIG. 12. The upper support 103 consists of two support beam assemblies connected via a hinge 17 to allow the upper support to fold in the center. Alternatively, a lock side 120 is used at both ends of the support beam assembly 18 as shown in FIG. 14.

Figure 9:
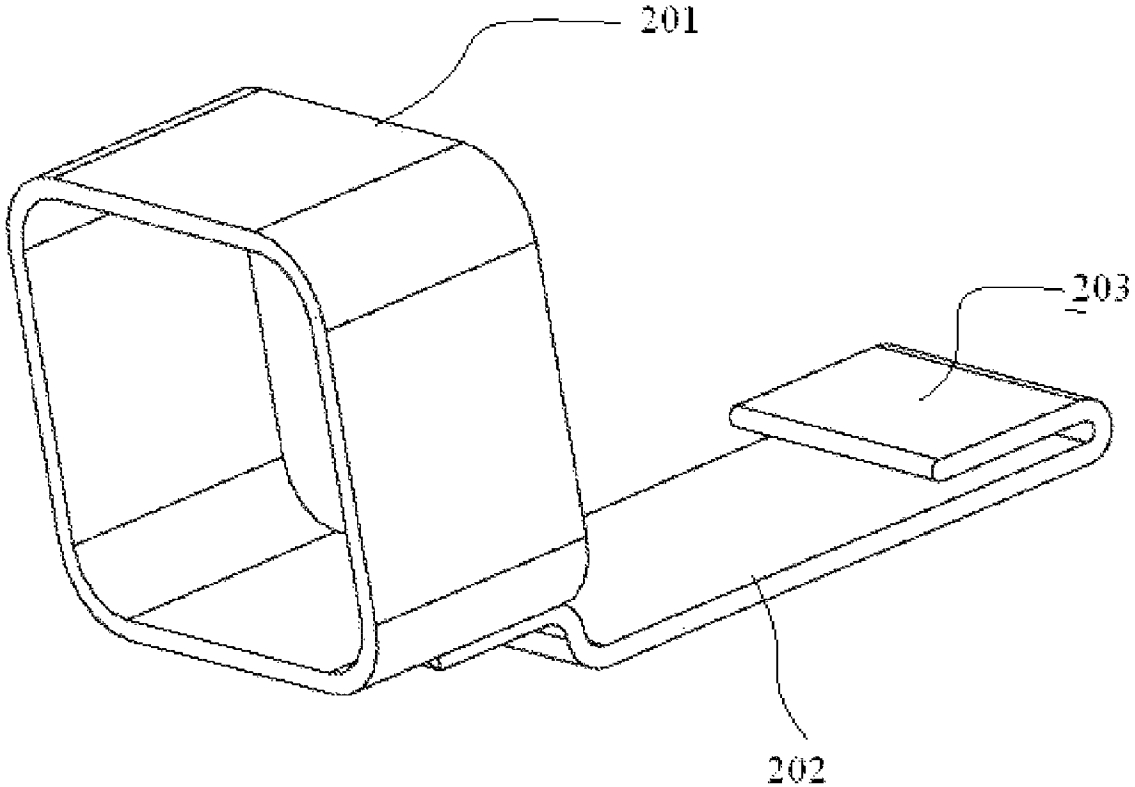
FIG. 9 shows the sheath groove.
Figure 11:
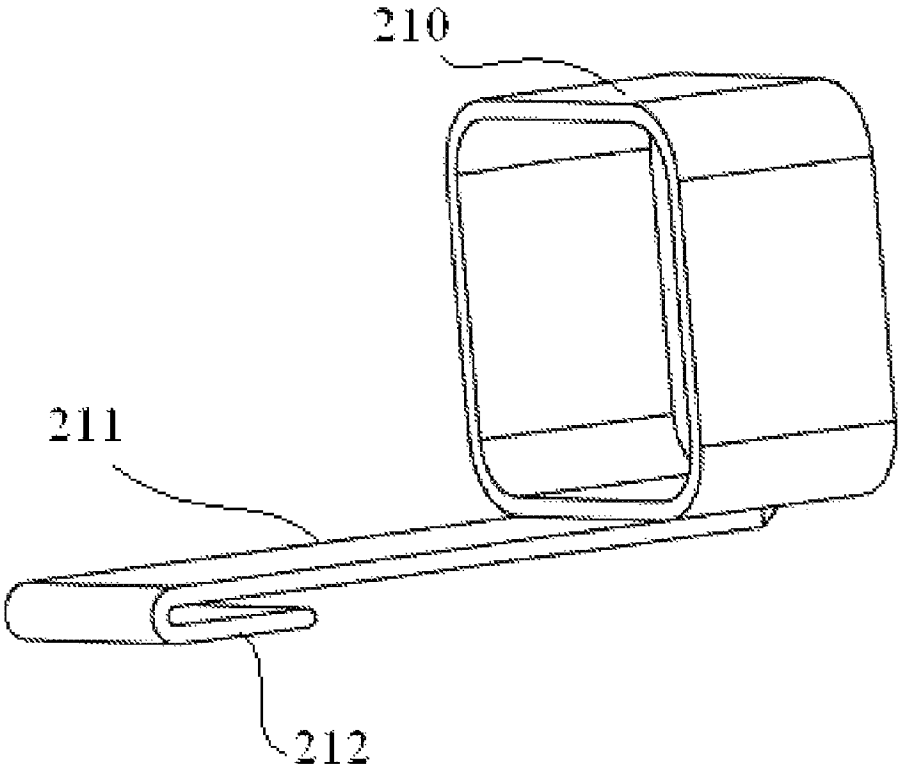
FIG. 11 shows the sheath tongue.
Figure 18:
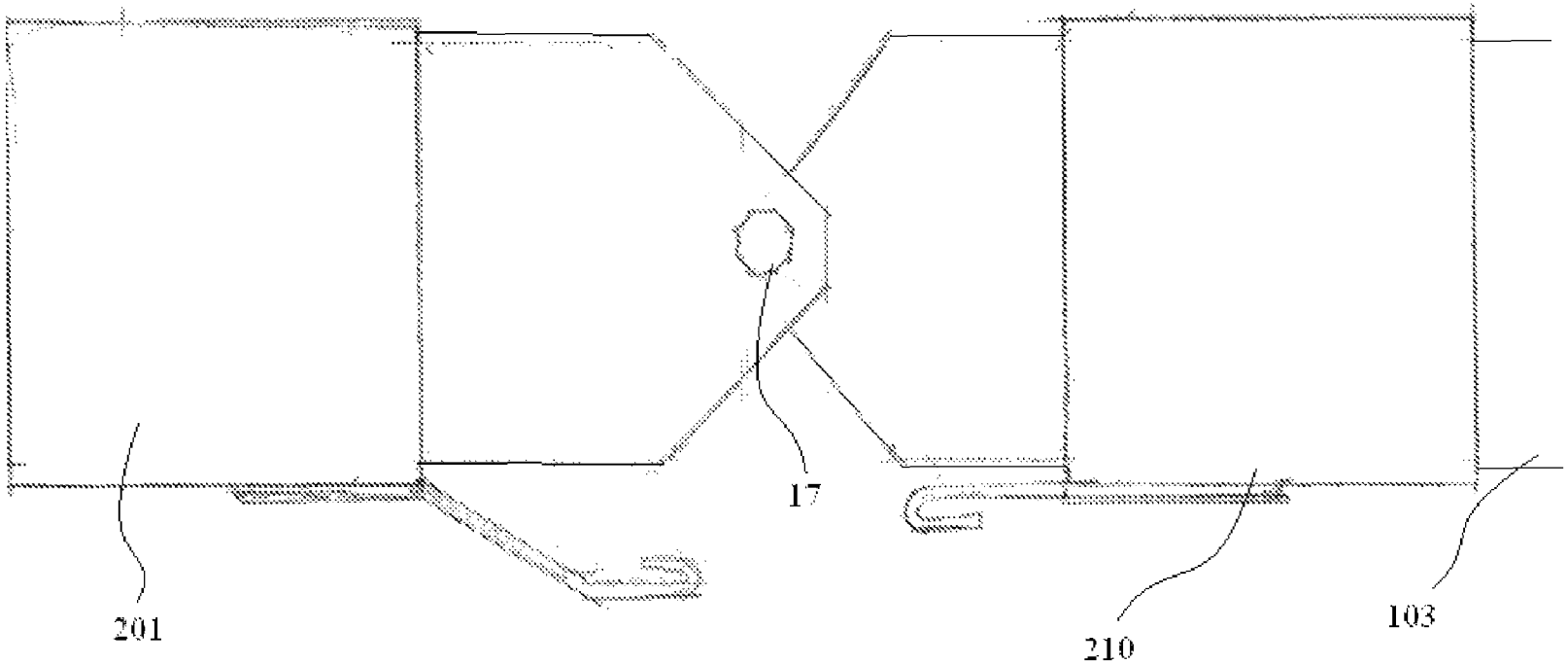
FIG. 18 shows the sheath groove shown in FIG. 9 and the sheath tongue shown in FIG. 11 in the unlocked position.
Figure 19:
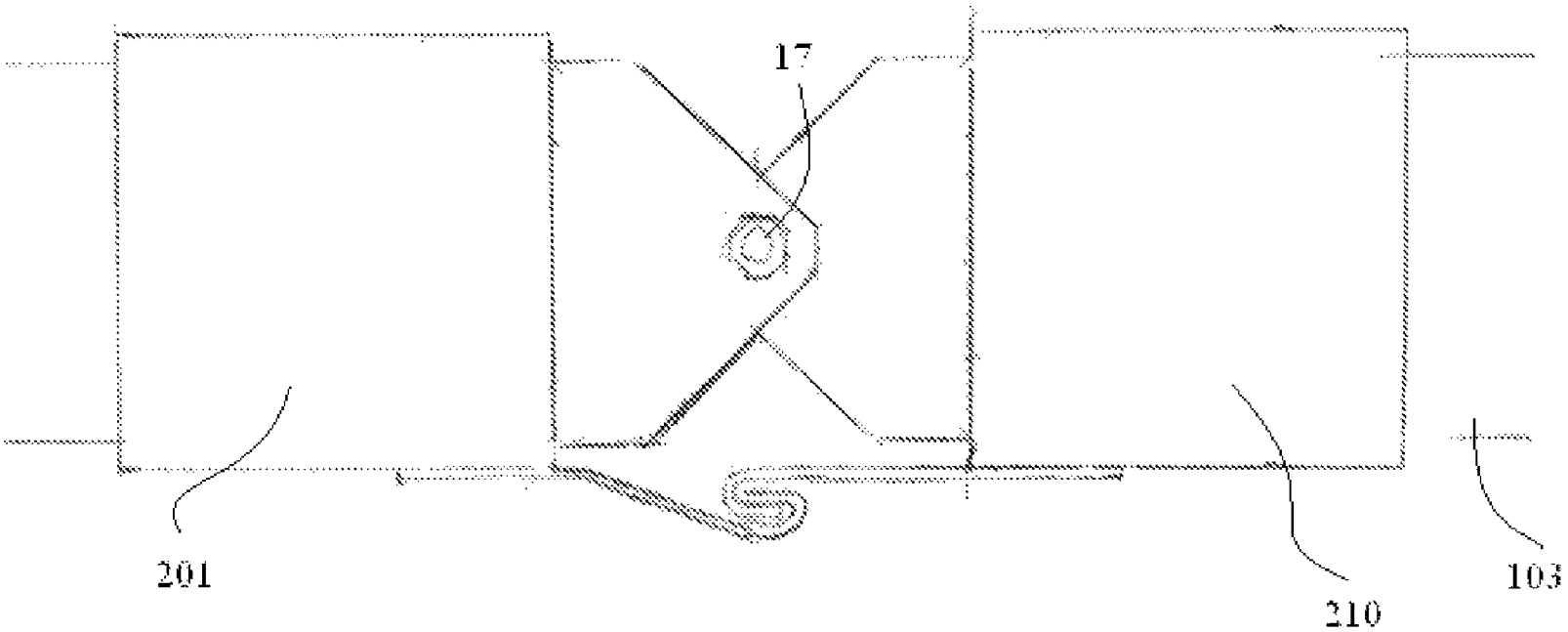
FIG. 19 shows the sheath groove shown in FIG. 9 and the sheath tongue shown in FIG. 11 in the locked position.

In one embodiment, the upper support 103 is locked in an extended state by means of the sheath mechanism shown in FIGS. 9 and 11. A sheath groove 201 and a sheath tongue 210 are coupled to the upper support 103. The sheath groove 201 has an extended member 202 and a hook 203. The sheath tongue 210 has an extending member 211 and a hook 212. In the unlocked configuration the sheath tongue 210 and the sheath groove 201 are positioned as shown in FIG. 18. As shown in FIG. 19, the hook 203 and hook 212 lock into position, thereby locking the sheath tongue 210 and the sheath groove 201 in position and further locking the upper support 103. It is understood that the either the sheath tongue 210, the sheath groove 201 or both can be locked into position by any suitable means such as by the use of clevis pins.

Figure 3:
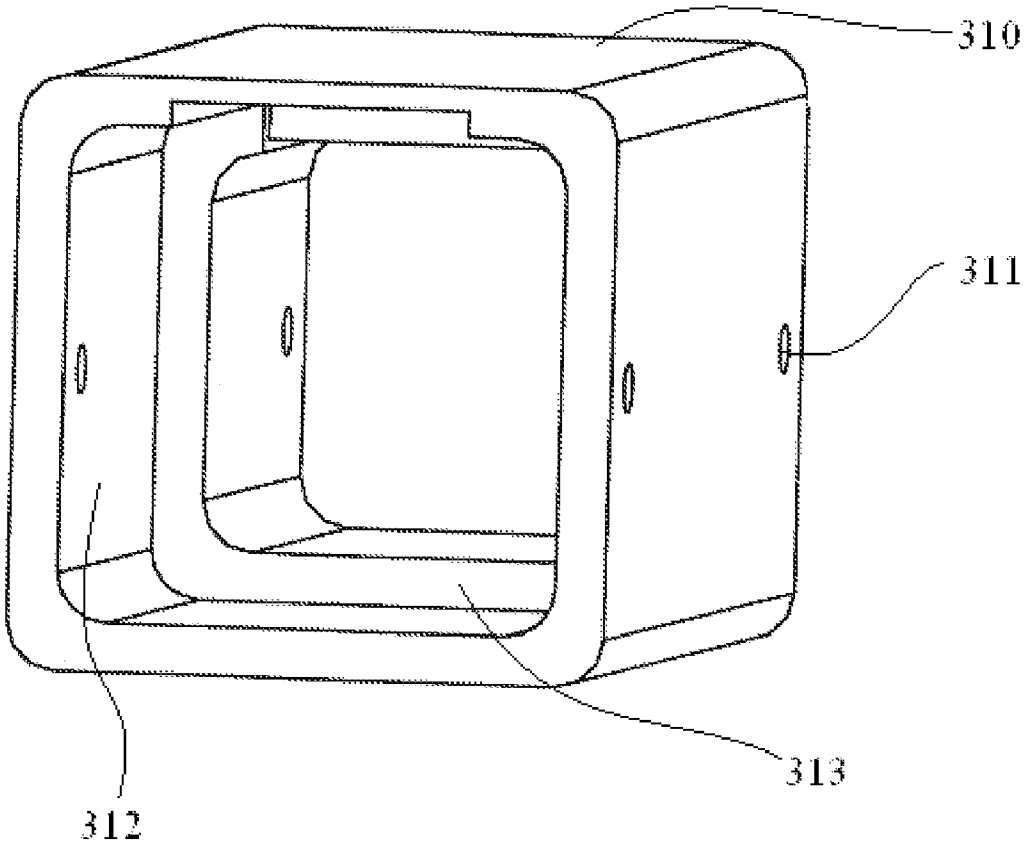
FIG. 3 shows the female sheath.
Figure 10:
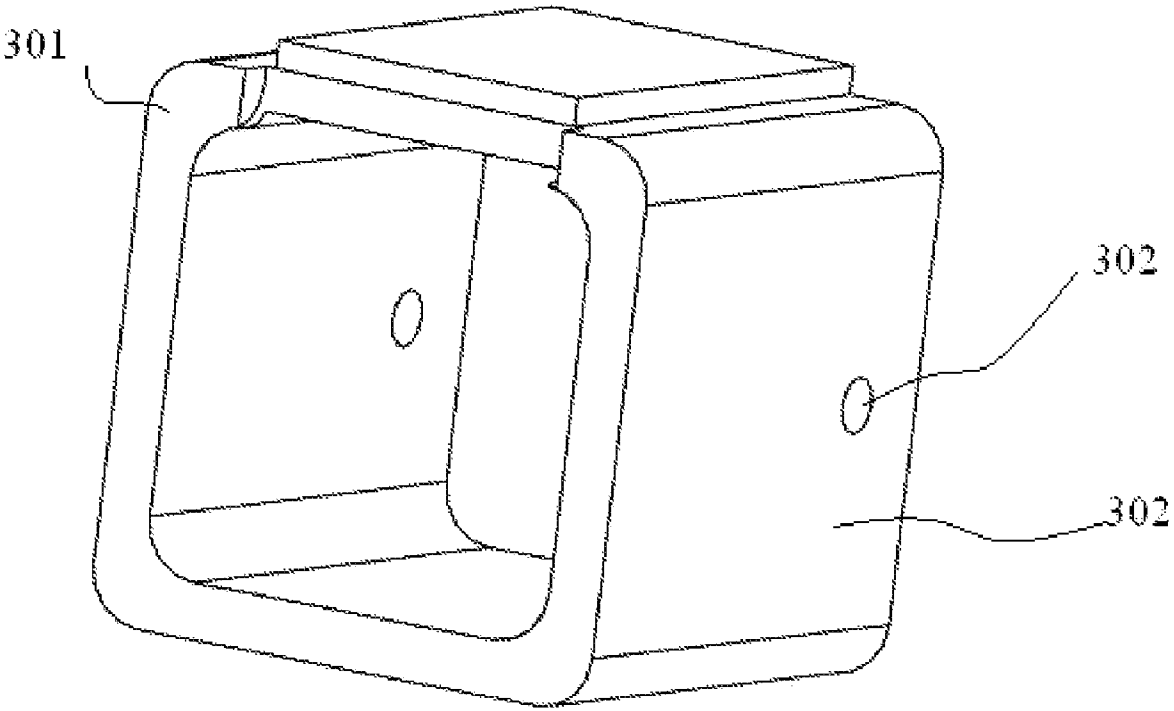
FIG. 10 shows the male sheath.
Figure 20:
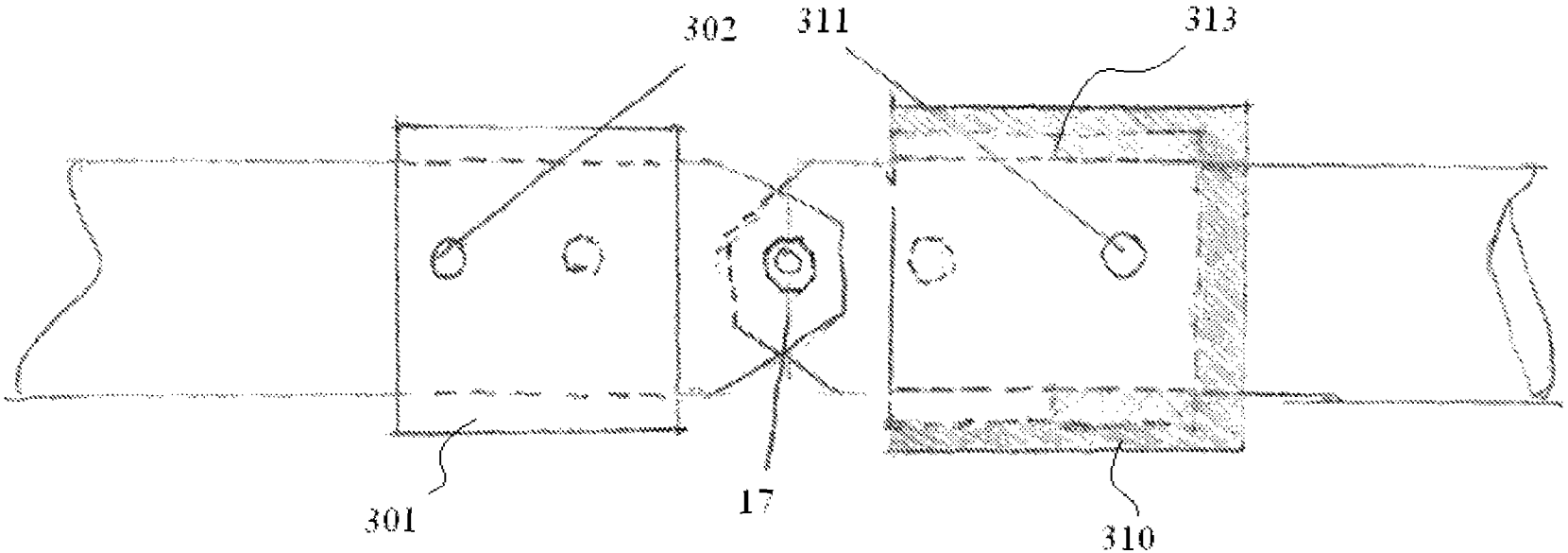
FIG. 20 shows the male sheath shown in FIG. 10 and the female sheath shown in FIG. 3 in the unlocked position.
Figure 21:
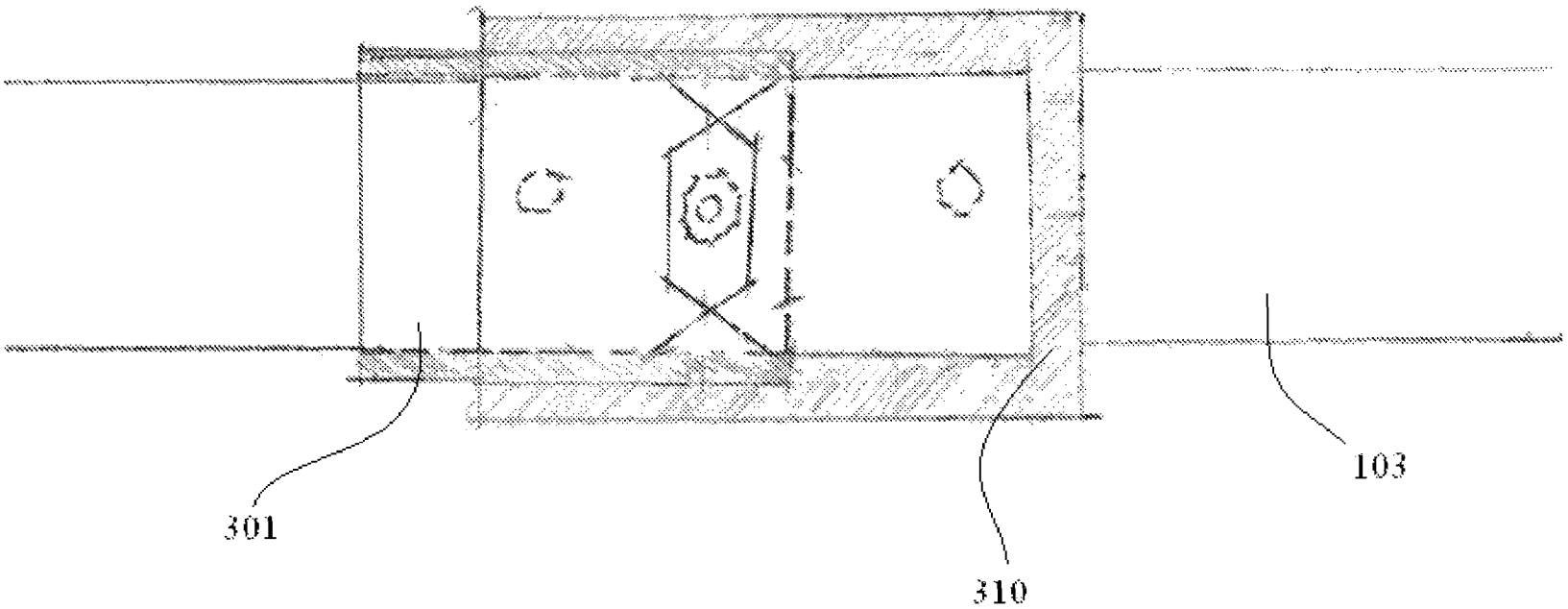
FIG. 21 shows the male sheath shown in FIG. 10 and the female sheath shown in FIG. 3 in the locked position.
Figure 22:
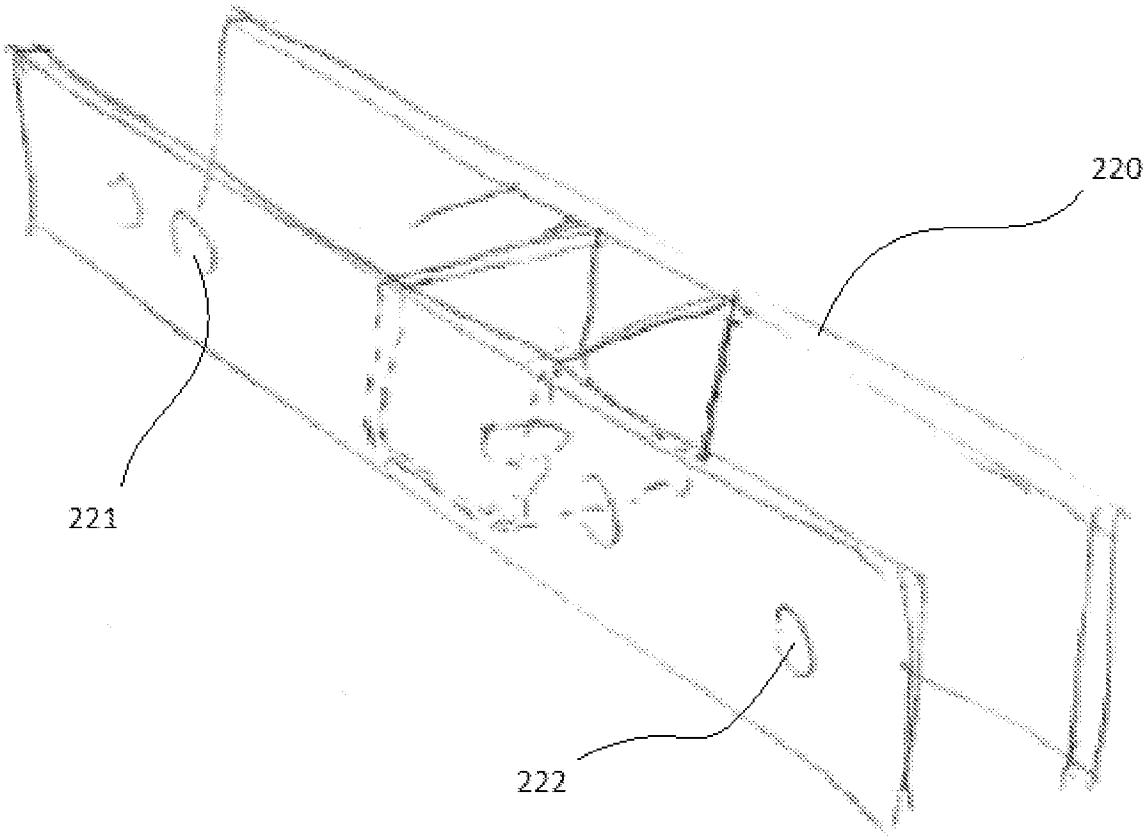
FIG. 22 shows an isometric view of the saddle according to one embodiment.
Figure 23:
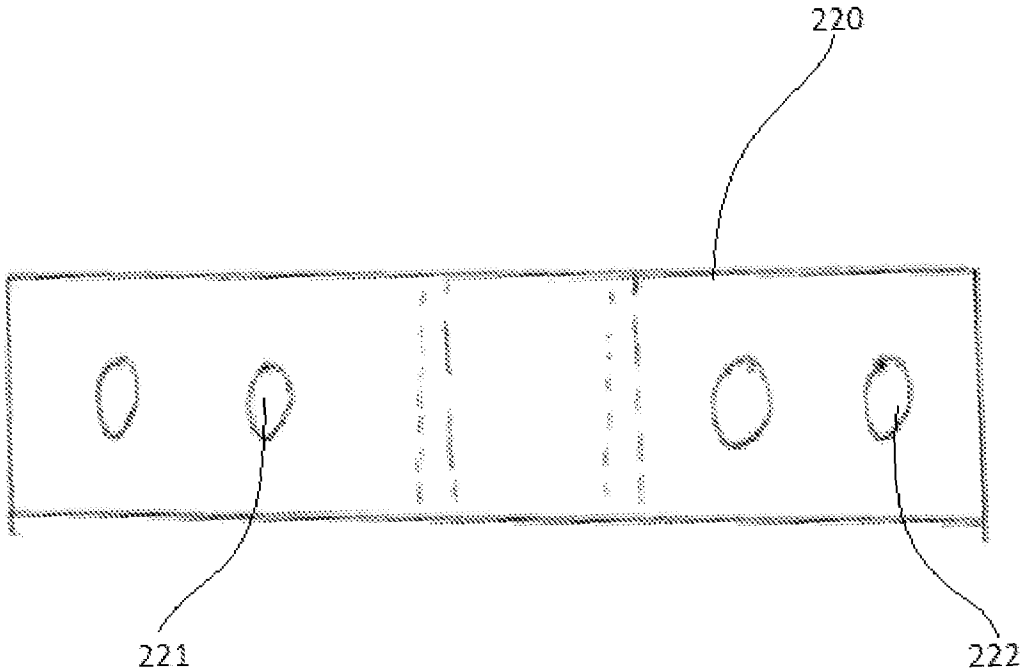
FIG. 23 shows a side view of the saddle shown in FIG. 22.
Figure 24:
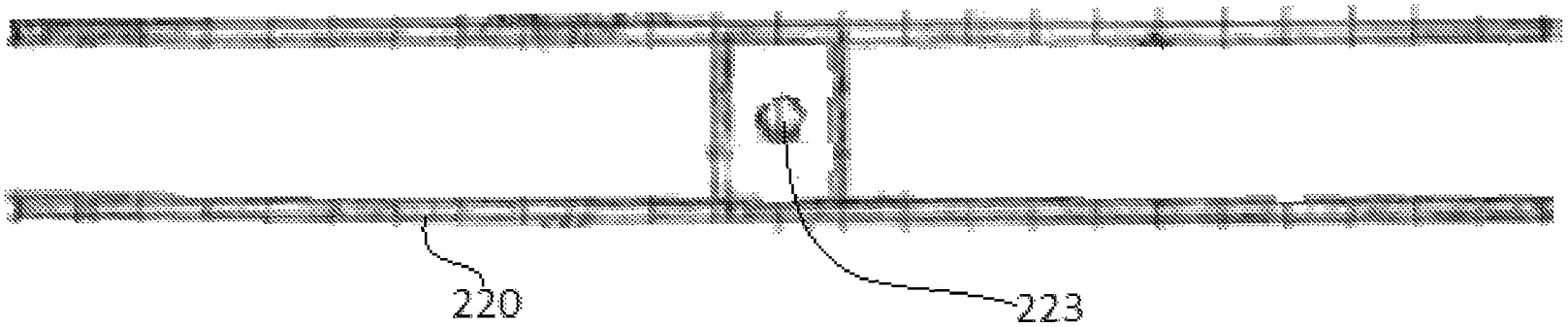
FIG. 24 shows a top view of the saddle show in FIG. 22.
Figure 25:
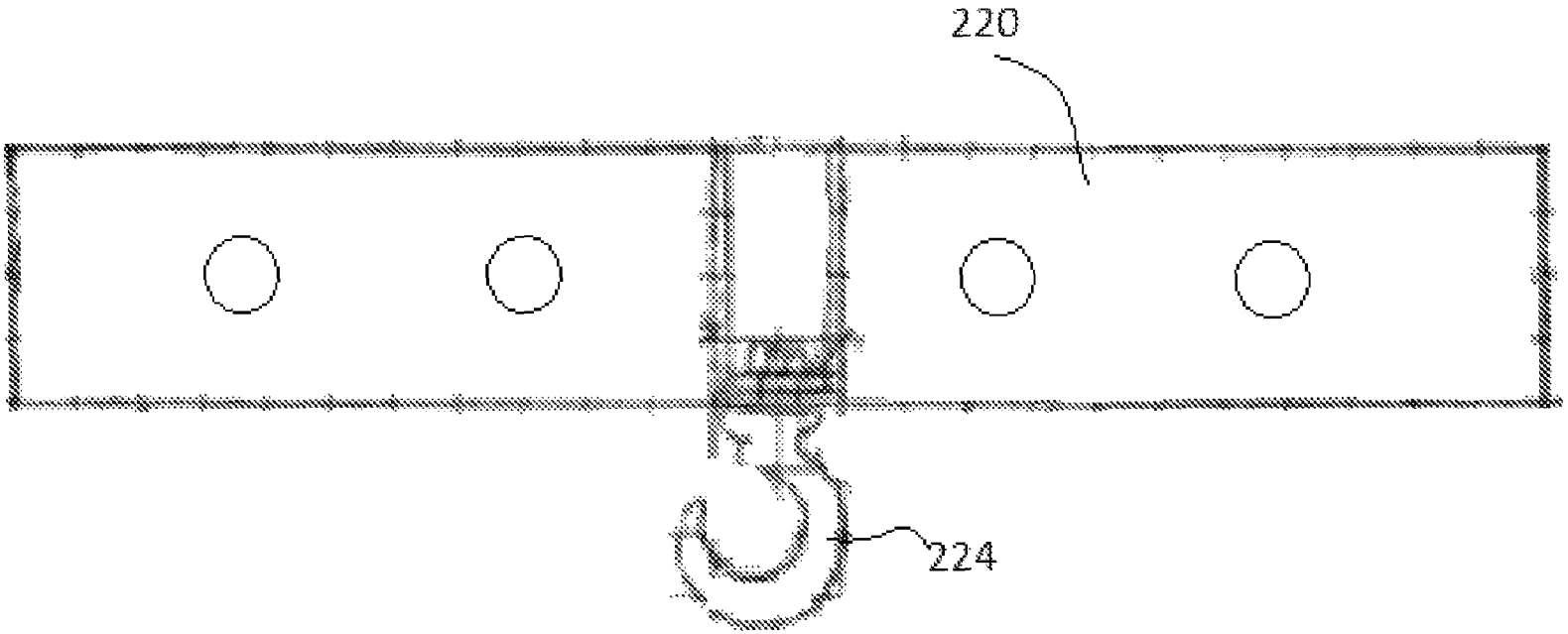
FIG. 25 shows a side view of the saddle shown in FIG. 22 with a hook attached.

In another embodiment, the upper support 103 is locked in an extended state by means of the sheath mechanism shown in FIGS. 3 and 10. A male sheath 301 and a female sheath 310 are coupled to the upper support 103. The male sheath has at least one locking pin hole 302 and an outer surface 303. The female sheath has at least one locking pin hole 311 and an inner surface 312. In the unlocked position shown in FIG. 20 the male sheath 201 and the female sheath 310 can slide along the upper support 103. In the locked position, as shown in FIG. 21, the inner surface 312 of the female sheath 310 slides over the outer surface 303 of the male sheath 301 to lock the hinge 17 in position. To lock the male sheath 301 and the female sheath 310 in position, optionally clevis pins or bolts are inserted through the locking pin holes 302 and 311. In one embodiment a single pin slides through both the locking pin hole 302 and the locking pin hole 311. In another embodiment, separate locking pins are used. It is understood that optionally, but not required, that the male of female sheath may have a terminating edge to limit travel of male or female sheath. The embodiment shown in FIGS. 20 and 21 show a terminating edge 313 on the female sheath 310 to limit travel of the male sheath 301.

Two angled support arms 18 are connected to the upper support 103 and to the leg assemblies to provide additional stability. One or both ends is held in place by a removable pin or bolt in order to allow for rapid disassembly.

As shown in FIGS. 22-25, a saddle 220 is attached to the upper support 103. In one embodiment, the saddle 220 may attach to the upper support 103 through the locking pin holes 302 or 311 found in the locking mechanism and corresponding locking pin holes 221 or 222 found in the saddle 220. The saddle 220 may contain a mounting hole 223 for a hook 224. In another embodiment, the saddle may set on top of the upper support 103. In yet a further embodiment, the saddle may have cut outs to retain the locking mechanism in place once attached.

Support pins and bolts used are preferentially half inch grade 8 or better steel for locking the leg assemblies.

A further description of a specific embodiment of the invention is provided as follows:

The complete hoisting frame collapses in the middle, the uprights fold inward and are manually retracted as well. The legs are stowed in the upright position and are locked in place.

The support assembly is the crossmember. This consists of two sections of rectangular steel tube 2"×4"×4'2"×3/16", reinforced internally ¼" strap steel, the full length of each section (A1A)

These sections are joined in the middle of the C-member by a device, called a sheath, by means of collars that contain bolts that fix sections to saddle with clevis pins to lock the sections in place, thereby making one rigid C-member.

The sheath joins the C-member sections. It consists of two 2'×4"×¼" plates joined by means of welds to a 3"×4"×¼" C channel, within the C-channel, the hoist hook is attached through a hole by a lock nut. The hook rides on a replaceable wear pad.

The leg assemblies are the uprights which support the C-member. These consist of two sections per side that slide within each other, that when upright allow the hoist to be raised to several heights. Within the lower tube, is a coil spring designed to assist the operator(s) in raising the upper tube. The reason for this is so one person can raise device by themselves if necessary.

The sections are secured to each other with clevis pins.

There are two legs per hoist end that fold down and are pinned with clevis pins to secure them in their down support position. They're also opposite each other. Wheels are attached; one per leg, so hoist can be rolled.

When hoist is in stowed position, the legs are secured in the upright position.

Figure 15:
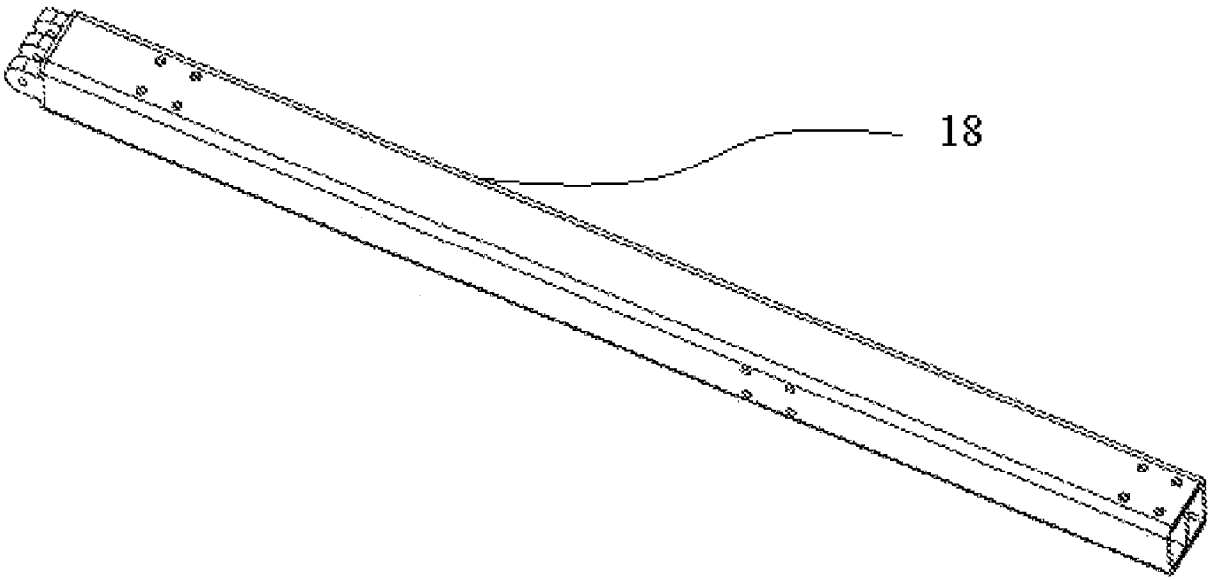
FIG. 15 shows the support beam assembly.
Figure 16:
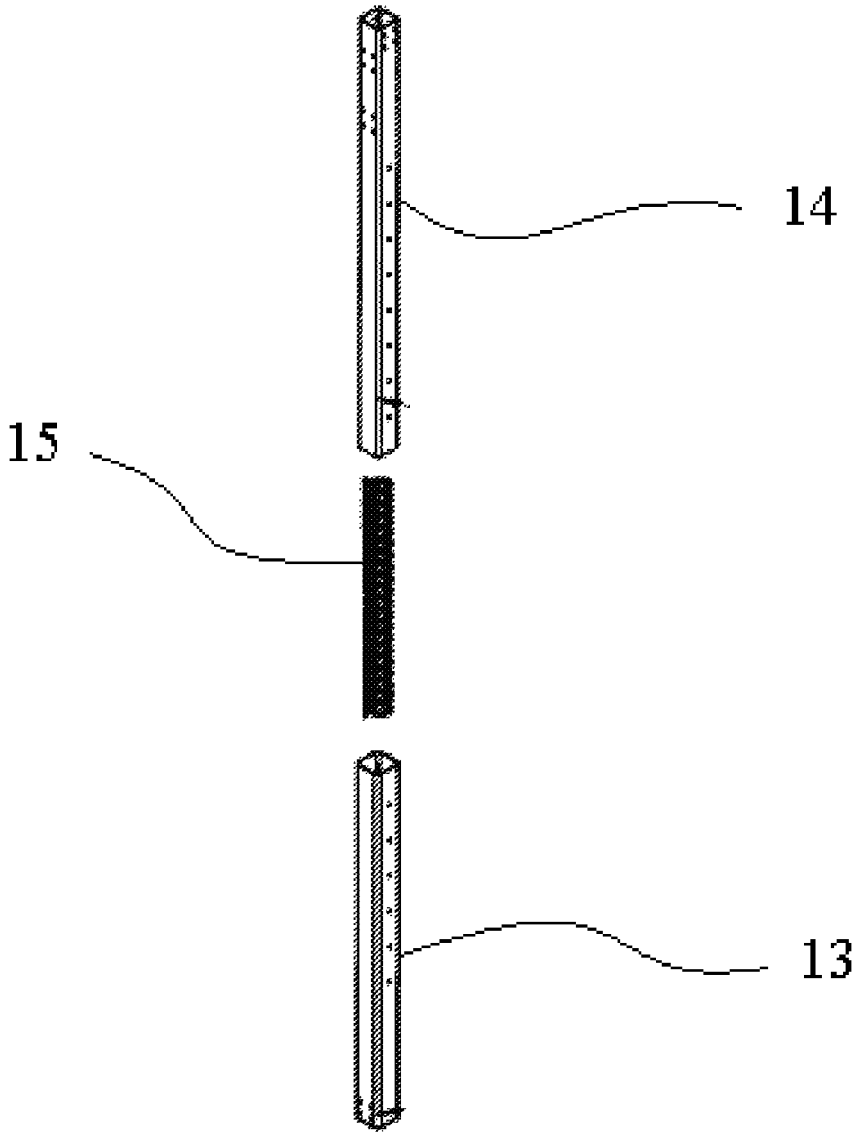
FIG. 16 shows the spring and support beam assembly.
Figure 17:
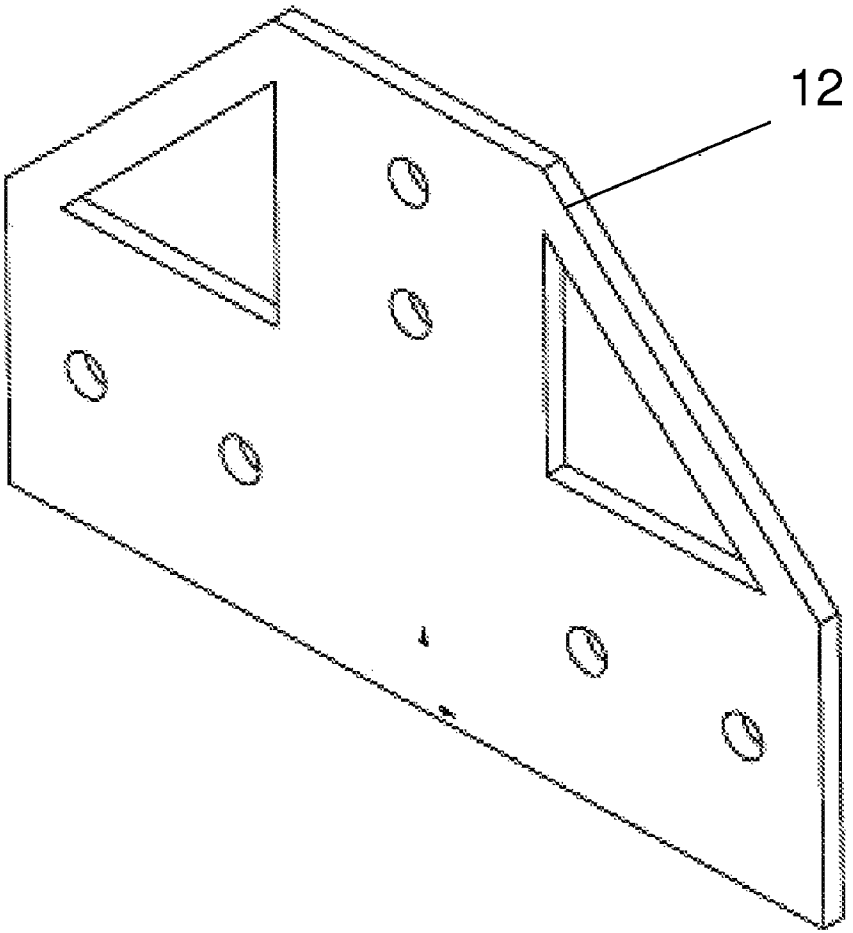
FIG. 17 shows the angle support.

An angle support as shown in FIG. 15 is bolted or welded to the bottom of the leg assembly. The leg bases are then pinned or bolted into place either in a collapsed position or in an extended position.

In an alternative embodiment, the leg assembly is locked into place using pivoting braces able to be pinned in place when uprights and legs are in operating position.

Figure 1:
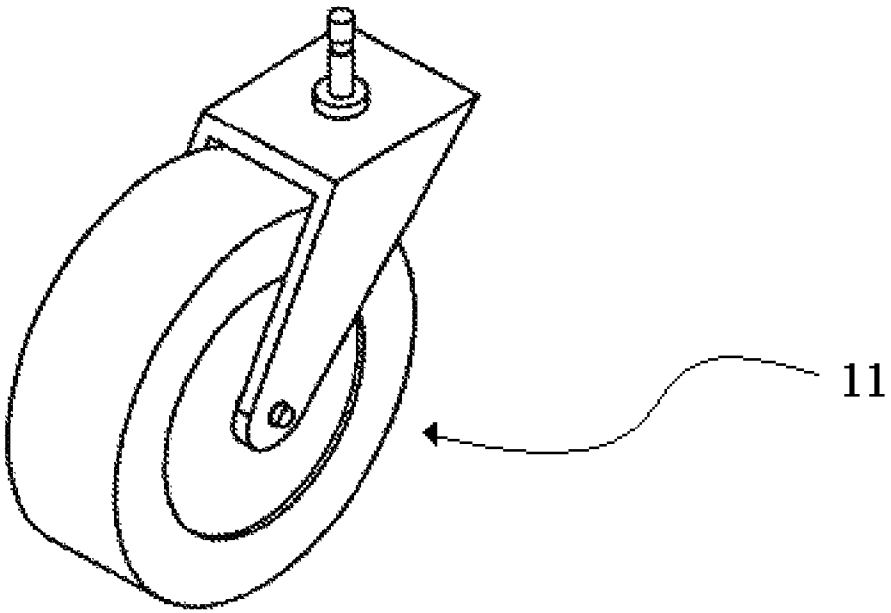
FIG. 1 shows a caster assembly.
Figure 2:
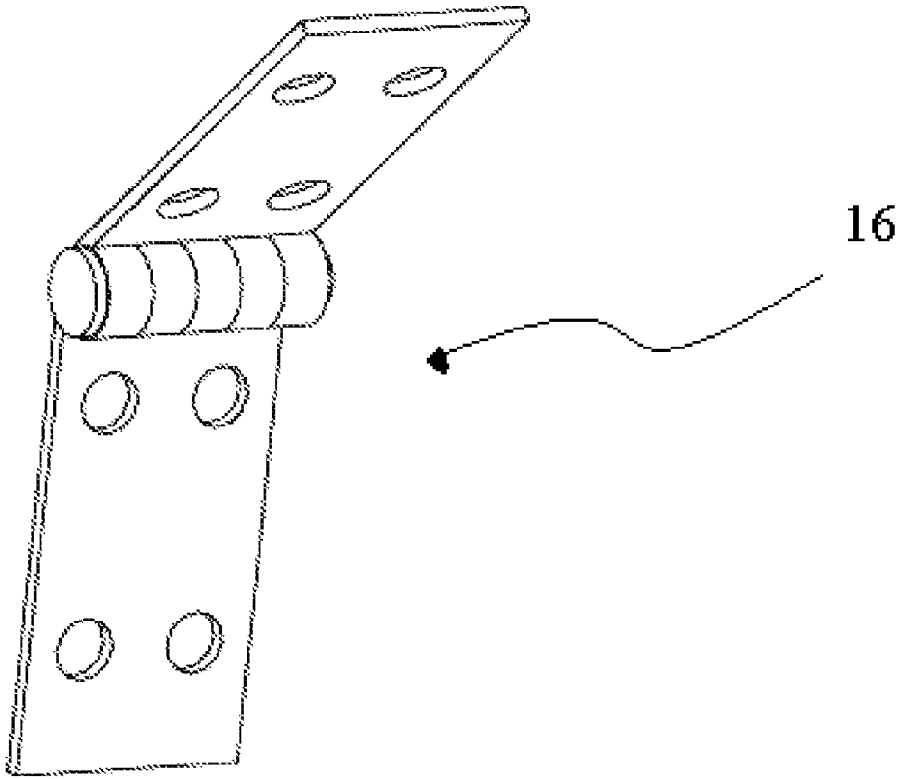
FIG. 2 shows the hinge assembly.

The castors shown in FIG. 1 are wheels that swivel and are removable. There are two sets, one for each leg, one set for hard, relatively even surfaces such as concrete, chat, etc. The other set would be inflatable, used for very uneven surfaces, such as would be found in a field, construction site, etc.

These next 2 components are not shown in drawing, but may be added, depending on the feasibility, and practicality.

First component would be a spring, or springs placed in or on the support assembly to assist in ease of unfolding C-member. These, as envisioned, would operate similarly to a diaper safety pin.

Second component would be a cable and pulley system incorporated into the design to assist in unfolding the hoist, and in addition assists in the raising and lowering of the C-member through the facilitation of the uprights. A hand operated winch using ¼" steel cable would be used to implement operation.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A hoist system comprising:

a frame comprising a top horizontal member having two support beam assemblies individually connected by a hinge, where the hinge is configured to fold up for storage or lock into position, two leg members each having a support base, an extendable central support and a folding support arm connected to the extendable central support at one end and to one of the two support beam assemblies at the other end, and a saddle for attaching a lifting mechanism; and a sheath assembly comprising:

a hinge locking mechanism for retaining said hinge in the locked position having an inner aperture larger than said top horizontal member to slide over the hinge, wherein when the hinge is in the locked position the hinge locking mechanism surrounds the two support beam assemblies and the hinge preventing the hinge from folding into the storage position, said hinge locking mechanism comprising;

a male sheath coupled to one of said two support beam assemblies with said male sheath having at least one locking pin hole; and a female sheath coupled to one of said two support beam assemblies with said female sheath having at least one locking pin hole and an internal surface configured to receive said male sheath, where sliding said male sheath into said female sheath prevents movement the hinge connecting the two support beam assemblies.

2. The hoist according to claim 1, wherein the hinge is locked into position by a bolt, a pin or a sleeve.

3. The hoist according to claim 1, wherein the height of the top horizontal member is at least eight feet above a surface the hoist on which the hoist is set up.

4. The hoist according to claim 1, wherein the height of the top horizontal member is at least ten feet above a surface the hoist on which the hoist is set up.

5. The hoist according to claim 1, wherein the hoist is constructed out of aluminum.

6. The hoist according to claim 1, wherein the total weight of the hoist is less than 500 pounds.

7. The hoist according to claim 1, wherein the total weight of the hoist is less than 300 pounds.

8. The hoist according to claim 1, wherein one or more of the extending support structures has wheels.

9. The hoist according to claim 1, wherein the hoist can support a minimum of 5000 pounds.

10. The hoist according to claim 1, wherein the hoist can support a minimum of 8000 pounds.

11. A hoist system comprising:

a frame comprising a top horizontal member having two support beam assemblies individually connected by a hinge, where the hinge is configured to fold up for storage or lock into position, two leg members each having a support base, an extendable central support and a folding support arm connected to the extendable central support at one end and to one of the two support beam assemblies at the other end, and a saddle for attaching a lifting mechanism; and a sheath assembly comprising:

a hinge locking mechanism for retaining said hinge in the locked position having an inner aperture larger than said top horizontal member to slide over the hinge, wherein when the hinge is in the locked position the hinge locking mechanism surrounds the two support beam assemblies and the hinge preventing the hinge from folding into the storage position, said hinge locking mechanism comprises:

a sheath groove coupled to one of said two support beam assemblies with said sheath groove having coupling with an extending member with a recess and a hook portion; and a sheath tongue coupled to one of said two support beam assemblies with said sheath tongue having coupling with an extending member with a hook portion wherein said sheath groove, hinge locking mechanism, and sheath tongue are removeably connected together for assembly and disassembly.

12. the hoist according to claim 11, further comprising a clevis pin inserted through the locking pin hole of the male sheath and the locking pin hole of the female sheath to connect the male and female sheath.

13. The hoist according to claim 11, where said sheath groove and sheath tongue have inverted hooks which removeably attachably connect together.

14. The hoist according to claim 1, further comprising detachable and attachable wheels connected to said support base.

15. The hoist according to claim 1, wherein said wheels are rolling castors.

16. A hoist system comprising:

a frame comprising a top horizontal member having two support beam assemblies having at least one locking pin hole and being individually connected by a hinge, where the hinge is configured to fold up for storage or lock into position, two leg members each having a support base, an extendable central support and a folding support arm connected to the extendable central support at one end and to one of the two support beam assemblies at the other end, and a saddle for attaching a lifting mechanism, the saddle having at least two locking pin holes that correspond to at least one locking pin hole on each of the two support beam assemblies; and at least two locking pins for retaining said hinge in the locked position by passing through the locking holes on the saddle and the corresponding locking hole on the support beam assemblies, wherein the locking pins being present retains the hinge in the locked position and removing the locking pins allows the hinge to fold into the storage position.

* * * * *